US006811517B1

(12) United States Patent
Eschenbach

(10) Patent No.: US 6,811,517 B1
(45) Date of Patent: Nov. 2, 2004

(54) POLESTRIDER EXERCISE APPARATUS WITH DUAL TREADS

(76) Inventor: Paul William Eschenbach, 290 S. Tyger La., Roebuck, SC (US) 29376

( * ) Notice: Subject to any disclaimer, the term of this patent is extended or adjusted under 35 U.S.C. 154(b) by 0 days.

(21) Appl. No.: 10/634,003

(22) Filed: Aug. 5, 2003

(51) Int. Cl.[7] ..... A63B 22/04
(52) U.S. Cl. ..... 482/52; 482/54
(58) Field of Search ..... 482/51–54, 57, 482/79, 80

(56) References Cited

U.S. PATENT DOCUMENTS

| | | | | |
|---|---|---|---|---|
| 3,316,898 | A | 5/1967 | Brown | 128/25 |
| 3,814,420 | A | 6/1974 | Encke | 272/83 R |
| 4,204,673 | A | 5/1980 | Speer et al. | 272/69 |
| 4,934,688 | A | 6/1990 | Lo | 272/70 |
| 4,961,570 | A | 10/1990 | Chang | 272/73 |
| 4,989,857 | A | 2/1991 | Kuo | 272/70 |
| 5,039,087 | A | 8/1991 | Kuo | 272/70 |
| 5,336,146 | A | 8/1994 | Piaget et al. | 482/54 |
| 5,538,489 | A | 7/1996 | Magid | 482/54 |
| 5,620,400 | A | 4/1997 | Foster | 482/51 |
| 5,669,856 | A | 9/1997 | Liu | 482/51 |
| 5,690,589 | A | 11/1997 | Rodjers, Jr. | 482/52 |
| 5,769,760 | A | 6/1998 | Lin et al. | 482/52 |
| 5,792,029 | A | 8/1998 | Gordon | 482/52 |
| 6,017,294 | A | 1/2000 | Eschenbach | 482/52 |
| 6,022,296 | A | 2/2000 | Yu | 482/52 |
| 6,461,279 | B1 * | 10/2002 | Kuo | 482/54 |
| 6,575,877 | B2 * | 6/2003 | Rufino et al. | 482/51 |
| 6,689,020 | B2 * | 2/2004 | Stearns et al. | 482/52 |
| 2001/0016542 | A1 | 8/2001 | Yoshimura | 482/54 |

OTHER PUBLICATIONS

Pole Striding Exercise and Vit. E for Management of Peripheral Vascular Disease by E.G. Collins et al., Medicine & Science in Sports & Exercise 2003; 35(3):384–393.

Effects of Exercise on Perceived Quality of Life of Individuals with Parkinson's Disease by Baatile et al. VA Research & Dev., J uenal of Rehabilitation R&D, vol. 37, No. 5, Sep./Oct. 2000.

* cited by examiner

*Primary Examiner*—Stephen R. Crow

(57) ABSTRACT

The present invention relates to a standup exercise apparatus that simulates PoleStriding. Lower body exercise including walking, jogging and climbing with upper body elliptical are exercise. More particularly, the present invention relates to an exercise apparatus having separately supported treadles with tread belts for the feet and arm exercise coordinated with the motion of the treadles. A linkage is provided to coordinate the up and down dependent movement of the treadles. Ski pole handle movement is coordinated with the treadle movement for total body PoleStriding. Low knee stress allows long duration exercise without hurting knees common with some crosstrainers.

26 Claims, 2 Drawing Sheets

POLESTRIDER EXERCISE APPARATUS WITH DUAL TREADS

BACKGROUND OF THE INVENTION

1. Field

The present invention relates to a standup dependent exercise apparatus that simulates walking, jogging and climbing with arm exercise that simulates rowing and ski pole motion. More particularly, the present invention relates to an exercise machine having separately supported treadles for the feet and arm exercise coordinated with the motion of the feet.

2. State of the Art

The benefits of regular exercise to improve overall health, appearance and longevity are well documented in the literature. For exercise enthusiasts the search continues for safe apparatus that provides total body exercise for maximum benefit in minimum time. PoleStriding refers to walking with a pair of ski poles for arm exercise as a total body exercise.

Clinical trials reported in the article "PoleStriding Exercise and Vitamin E for Management of Peripheral Vascular Disease" by Eileen G. Collins et al. appearing in Medicine & Science in Sports & Exercise 2003; 35(3):384–393 provide strong evidence that PoleStriding significantly improved exercise tolerance with reduced claudication pain in the participants of the trials. Other clinical trials such as "Effect of exercise on perceived quality of life of individuals with Parkinson's disease" by J. Baatile et al. appearing in VA Research & Development, Journal of Rehabilitation Research and Development, Vol. 37, No. 5, September/October 2000 report improved quality of life after 8 weeks of PoleStriding. One common complaint of PoleStriding participants is the unusual appearance of walking in public with ski poles.

Magid in U.S. Pat. No. 5,538,489 shows a walker apparatus with left and right foot belts having independent belt movement. Yoshimura in U.S. Pat. Application No. 2001/0016542 shows a pair of tread belts pivoted in the front to provide independent stepper movement. Piaget et al. in U.S. Pat. No. 5,336,146 shows a pair of dual reciprocating treads pivoted in the rear acting independently against damper resistance. Speer et al. in U.S. Pat. No. 4,204,673 shows a dual-tread exercise having one tread for each foot. Liu in U.S. Pat. No. 5,669,856 shows a stepper exercise device also having dual treads.

Foster in U.S. Pat. No. 5,620,400 shows dependent forward pivot foot support members connected to hand levers for mountain climbing exercise. Chang in U.S. Pat. No. 4,961,570 shows dependent forward pivoted foot support members as part of a linkage having a crank to determine step range. Lo in U.S. Pat. No. 4,934,688 shows a dependent stepper that drives a flywheel. Kuo in U.S. Pat. Nos. 4,989,857 and 5,039,087 uses forward pivoted foot support members powered by a motor through a crank.

The treadle category has the foot support members pivoted or guided rearward the operator allowing the foot to move up and down wherein the toe moves faster than the heel. Brown in U.S. Pat. No. 3,316,898 shows foot support members slidably pivoted rearward the operator with elliptical foot motion. Encke in U.S. Pat. No. 3,814,420 offers foot support members pivoted rearward the operator with treadle motion controlled by lever action. Eschenbach in U.S. Pat. No. 6,017,294 offers rearward pivoted treadle pedal movement coordinated with arm exercise. Gordon in U.S. Pat. No. 5,792,029 shows rearward pivoting foot support members that support foot trolleys for back and forth foot motion coordinated by belts to up and down foot support member motion.

Arm exercise with elliptical hand motion has recently appeared in the art. Yu in U.S. Pat. No. 6,022,296 shows a dependent stepper with elliptical hand motion. Rodgers, Jr. in U.S. Pat. No. 5,690,589 and Lin et al. in U.S. Pat. No. 5,769,760 show elliptical hand motion coordinated with elliptical foot motion.

There remains a need for a stationary exercise apparatus that simulates PoleStriding to give users the benefits of PoleStriding exercise reported in clinical trials without concern for weather or public appearance. There also remains a need to combine walking exercise with arm exercise having ski pole movements found in PoleStriding. There also remains a need to combine up and down inclined foot motion on tread belts having low knee stress with elliptical hand motion to exercise muscles in an alternative manner. There also remains a need for an exercise apparatus that provides climbing foot movements not found with stepper exercise apparatus combined with arm exercise.

One objective of the present invention is to provide total body exercise that simulates PoleStriding. Another objective of the present invention is to provide smooth up and down treadle motion with walking tread belt movement coordinated with elliptical hand movement. Another objective of the present invention is to provide a control system that allows the tread belts speed to be coordinated with the up and down treadle movement speed.

SUMMARY OF THE INVENTION

The present invention relates to the kinematic motion control of a pair of treadles each having a continuous tread belt to simulate walking, jogging and climbing during operation. More particularly, apparatus is provided that offers variable intensity exercise through a leg and arm operated cyclic motion in which the treadle supporting each foot is guided through successive positions during the up and down motion cycle while a load resistance acts upon the mechanism.

The treadles are guided through up and down inclined movement with tread belts for walking foot movement and handles coordinated with treadle movement for elliptical hand movement to simulate PoleStriding.

In the preferred embodiment, the apparatus includes a pair of treadles each having a tread belt with each treadle pivoted rearward the user. The front end of each treadle is supported by a connecting link for up and down movement. A pair of cranks control the up and down movement of the connecting links. Handles with hand grips are removably attached to the upper ends of the connecting links. As the cranks rotate, the treadles move up and down while the hand grips follow an elliptical ski pole motion. The tread belts are motor driven to encourage walking or jogging uphill. Different arm exercise occurs such as rowing or ski pole movement depending upon the direction of crank rotation.

A flywheel and alternator are used with adjustable load resistance to ensure smooth motion. Of course, other forms of adjustable load resistance such as friction belt, magnetic, air fan, etc. can be used in lieu of the alternator. A motor is used to drive the tread belts for walking and jogging. Of course, the tread belts can be manually driven by the rearward movement of the feet acting against load resistance. Also the cranks can be motor driven to control the speed of the treadle motion. A control system is provided to adjustably coordinate the motor speed of the tread belts with the crank speed.

An alternate embodiment would replace the crank and connecting links as a treadle movement means with a linkage or flexible linking such as a belt and pulley to raise one treadle as the other lowers.

In summary, this invention provides the operator with stable treadles with tread belts having adjustable intensity motions that simulate walking, jogging and climbing with very low joint impact while offering reversible elliptical hand motion for coordinated upper body exercise to simulate PoleStriding.

BRIEF DESCRIPTION OF THE DRAWINGS

The foregoing and other objects and features of the present invention will become more fully apparent from the following description and claims, taken in conjunction with the drawings. Understanding that these drawings depict only typical embodiments of the invention and are, therefore, not to be considered limiting of its scope or combinations, the invention will be described with additional specificity and detail through use of the accompanying drawings in which:

DETAILED DESCRIPTION OF THE EMBODIMENT

Figure 1:
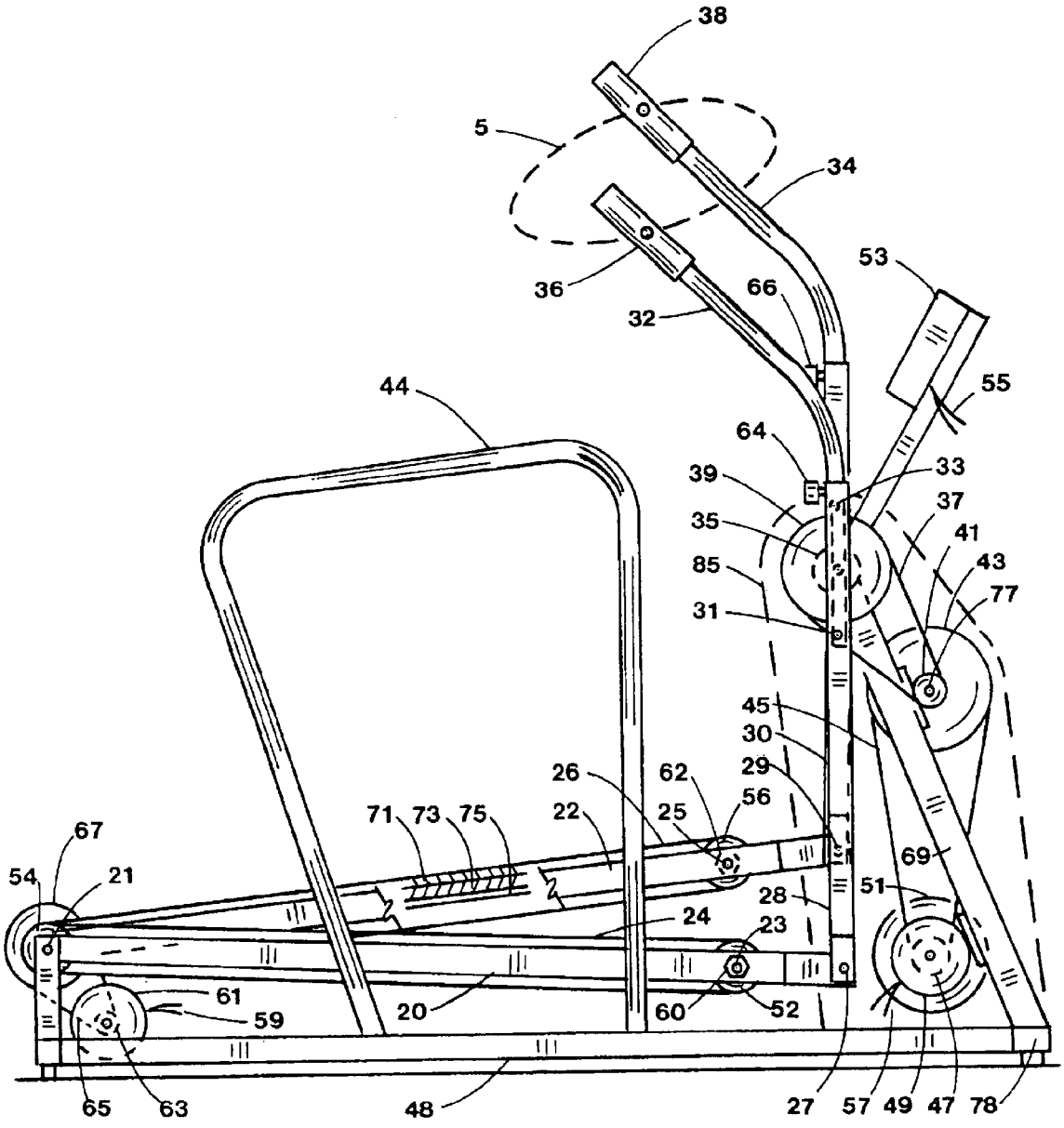
FIG. 1 is a right side elevation view of the preferred embodiment of an exercise machine constructed in accordance with the present invention.
Figure 2:
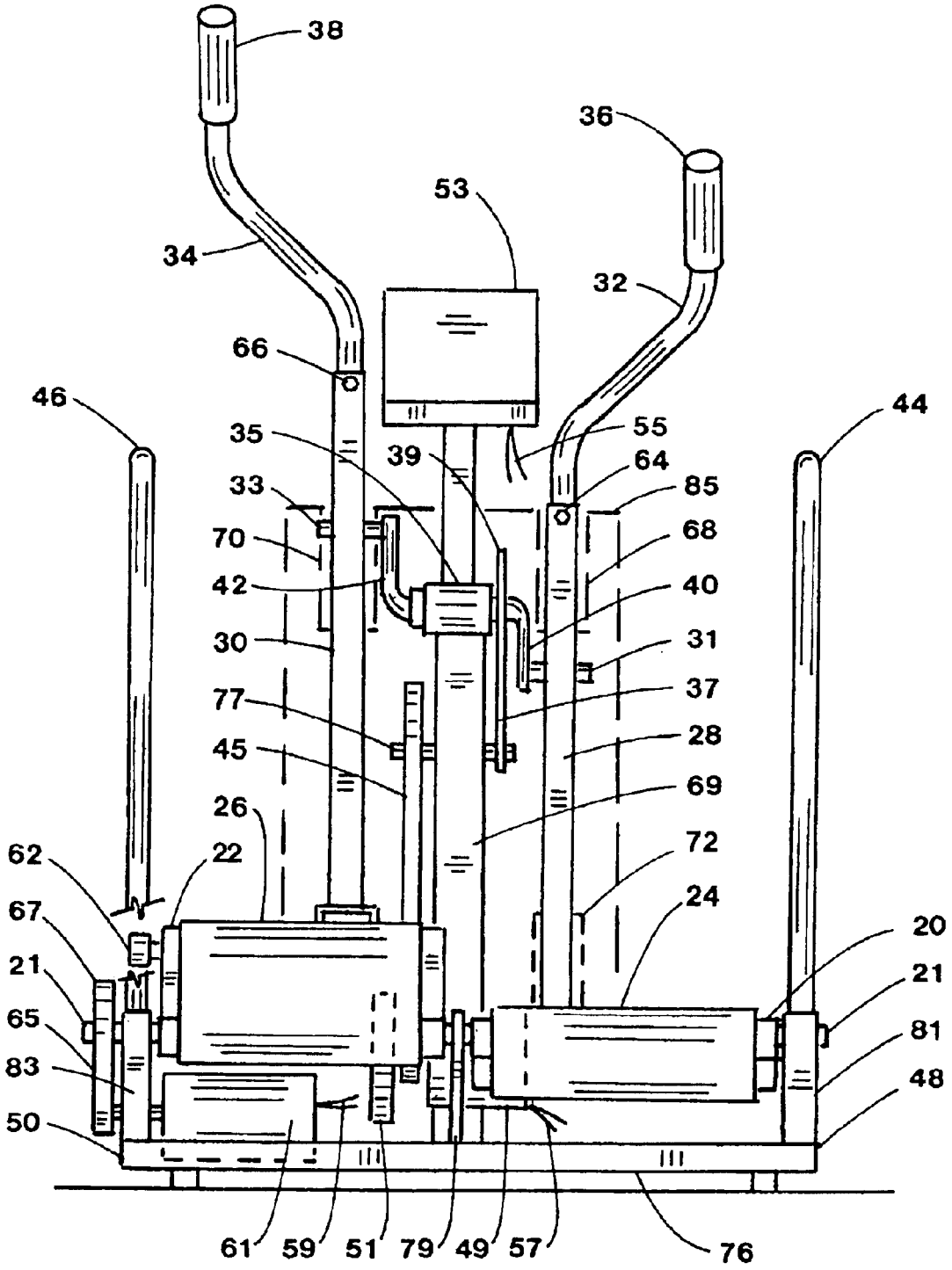
FIG. 2 is the rear view of the preferred embodiment shown in FIG. 1.

Referring to the drawings in detail, treadles 20,22 are shown in FIGS. 1 and 2 in the most downward and upward positions of the preferred embodiment. Treadles 20,22 are pivotally connected to shaft 21 on one end and connected at pivots 27,29 to connecting links 28,30 on the other ends. Cranks 40,42 are connected to frame member 69 by crank bearing housing 35. Connecting links 28,30 are connected to cranks 40,42 at crank pivots 31,33. Rotation of cranks 40,42 cause treadles 20,22 to reciprocate up and down about shaft 21 with pivots 27,29 following arcuate paths (not shown).

Tread belt 24 is engaged with rollers 52 and 54 while tread belt 26 is engaged with rollers 56 and 58 (not shown). Rollers 52,56 are connected to treadles 20,22 at pivots 23,25. Rollers 54 and 58 are attached to shaft 21 which is supported to rotate by upright supports 81,83. Each tread belt 24,26 is supported between rollers 52,54 and 56,58 by decks 71, cushions 73 and cushion supports 75 attached to treadles 20,22.

Handles 32,34 are removably attached to the upper ends of connecting links 28,30. Knobs 64,66 can be loosened to remove handles 32,34 for walking or jogging only exercise. Hand rails 44,46 are attached to frame members 48,50 to aid in walk or jog only exercise. Hand grips 36,38 are attached to handles 32,34 and follow the elliptical curve 5 when cranks 40,42 are rotated for arm exercise.

Frame members 48,50 are connected by frame members 76,78 to rest upon a supporting surface. Uprights 79,81,83 are attached to frame member 76 to support shaft 21. Frame member 69 is attached to frame member 78 to support crank bearing housing 35, jackshaft 77 and alternator 49.

Pulley 39 is attached to cranks 40,42 and engaged with pulley 41 by chain 37. Pulleys 41 and 43 are attached to jackshaft 77. Belt 45 engages pulleys 43 and 47 to drive flywheel 51 and alternator 49. Pulley 67 is attached to shaft 21 and engaged with pulley 63 by belt 65. Motor 61 drives tread belts 24,26. It is understood that other forms of resistance such as magnetic, air fans, alternators, etc. may also be used.

Alternately, motor 61 can be a flywheel/alternator driven by tread belts 24,26 as the feet of the user move rearward towards shaft 21. Knobs 60,62 can be rotated to adjust the resistance to rotation of rollers 52,56. Conventional spring/disc resistance (not shown) can be used with knobs 60,62. Alternately, the alternator 49 can become a motor to drive cranks 40,42 to reciprocate treadles 20,22 and handles 32,34. Control system 53 is connected to alternator/motor 49 and motor/alternator 61 by conventional wiring (not shown) to connect wires 55,57,59.

Typical operation initiates when the user climbs upon treadles 20,22 with the right foot upon tread belt 24 and the left foot upon tread belt 26 using hand rails 44,46 for assist. Grasping hand grips 36,38, the user rotates the hand grips 36,38 along elliptical path 5 while the feet of the user pump treadles 20,22 up and down as cranks 40,42 rotate. Alternator 49 provides load resistance while flywheel 51 develops momentum to overcome the dead spot positions of cranks 40,42. Motor 61 starts to move the tread belts 24,26 by manual switching or automatic control. Tread belt speed can be adjusted manually or set to increase with an increase in crank 40,42 rotation speed. For convenience, the tread belt 40,42 speed control can be mounted upon one of hand grips 36,38 (not shown). An operator can use this PoleStriding simulator for long periods because the knees do not hurt after extensive exercise, as is common for some users of elliptical crosstrainers.

Hand grip 36,38 movement can be reversed to follow the elliptical path 5 in either direction of rotation to exercise different muscles. Handle 32,34 movement simulates PoleStriding wherein the walker grasps ski poles in each hand to assist walking.

Another variation of control, would connect shaft 21 to cranks 40,42 by a flexible linking such as a long chain (not shown) in lieu of motor 61 and a transmission (not shown) to change the speed ratio. As the cranks 40,42 are rotated, the tread belts 24,26 speed could be adjusted for different stride length.

Shroud 85 covers the cranks 40,42, connecting links 28,30, chain 37 and belt 45. Slots 68,70 allow the upper ends of connecting links 28,30 to exit shroud 85 during operation. Slots 72 and 74 (not shown) allow treadles 20,22 to exit shroud 85.

With handles 32,34 removed, treadles 20,22 can be pumped by the feet of a user to move up and down with each step while the hands of the user remain on hand rails 44,46 or hands free.

The present invention may be embodied in other specific forms without departing from its spirit or essential characteristics. The described embodiments are to be considered in all respects only as illustrative, and not restrictive. The scope of the invention is, therefore, indicated by the claims, rather than by foregoing description. All changes which come within the meaning and range of equivalency of the claims are to be embraced within their scope.

What is claimed is:

1. An exercise machine comprising:

a framework, said framework configured to be supported on a supporting surface;

a pair of cranks, each said crank rotatably connected to said framework;

a pair of treadles, each said treadle operably associated with said framework;

a pair of connecting links, each connecting link pivotally connected to said crank and to a respective said treadle;

a pair of tread belts, each said tread belt operably associated with one of said treadles;

each said treadle having generally opposing up and down treadle movement relative to said framework when the foot of the user is rotating said crank whereby the foot of said user moves said tread belt relative to said treadle as said treadle moves downward under the weight of said user.

2. The exercise machine according to claim 1 further comprising a pair of rollers, said pair of rollers pivotally connected to a respective said treadle to support one of said tread belts.

3. The exercise machine according to claim 1 further comprising a pair of decks, each said deck positioned generally under the upper surface of a respective said tread belt and supported by a respective said treadle.

4. The exercise machine according to claim 1 further comprising a pair of cushion systems, each said cushion system operably associated with said deck and said treadle.

5. The exercise machine according to claim 1 further comprising a pair of handles, each said handle operably associated with a respective said treadle whereby said handle provides arm exercise.

6. The exercise machine according to claim 5 wherein said handle further comprises a pair of hand grips whereby each said hand grip follows an elongate curve path.

7. The exercise machine according to claim 1 further comprising tread belt resistance, said tread belt resistance being adjustable to regulate the movement of said tread belt relative to said treadle.

8. The exercise machine according to claim 1 further comprising a motor, said motor operably associated with said tread belts to regulate the speed of said tread belts relative to said treadle.

9. The exercise machine according to claim 1 further comprising a flexible linking, said flexible linking operably associated with said cranks and said tread belts to coordinate the movement of said tread belts to the rotation of said cranks.

10. The exercise machine according to claim 1 further comprising a load resistance, said load resistance operably associated with said crank.

11. The exercise machine according to claim 1 further comprising a flywheel, said flywheel rotatably connected to said framework and operably associated with said crank.

12. The exercise machine according to claim 1 further comprising a control system, said control system operably associated with said cranks and said tread belts to regulate their relative movements.

13. The exercise machine according to claim 1 further comprising a shroud, said shroud configured to enclose said cranks and having slots to allow the exit of said connecting links.

14. An exercise machine comprising:

a framework, said framework configured to be supported on a supporting surface;

a pair of treadles, each said treadle having a treadle pivot means attached to said framework;

a treadle movement means, said treadle movement means operably associated with each said treadle to provide generally opposing dependent up and down movement for said treadles;

a pair of rollers for each treadle, said pair of rollers operably associated with a respective said treadle;

a pair tread belts, each said tread belt engaged with said pair of rollers;

each said treadle having generally opposing up and down dependent treadle movement relative to said framework when the foot of the user acts upon said treadle movement means and said tread belt moves relative to said treadle as said treadle moves downward under the weight of said user.

15. The exercise machine according to claim 14 wherein said treadle movement means comprises a crank, said crank rotatably connected to said framework, and a pair of connecting links, each said connecting link pivotally connected to said crank and to one of said treadles.

16. The exercise machine according to claim 14 further comprising a handle means, said handle means operably associated with said treadle movement means whereby said handle means provides arm exercise.

17. The exercise machine according to claim 16 wherein said handle means further comprises a hand grip whereby said hand grip follows an elongate curve path.

18. An exercise machine comprising:

a framework, said framework configured to be supported on a supporting surface;

a crank, said crank rotatably connected to said framework;

a pair of treadles, each said treadle operably associated with said framework;

a pair of connecting links, each connecting link pivotally connected to said crank and to a respective said treadle;

a pair of rollers for each treadle, said pair of rollers pivotally connected to a respective said treadle;

a pair of tread belts, each said tread belt operably associated with a pair of said rollers;

a pair of handles, each said handle operably associated with a respective said treadle;

each said treadle having generally opposing up and down treadle movement relative to said framework when the foot of the user is rotating said crank whereby said foot of said user moves said tread belt relative to said treadle and the hand of said user moves said handle.

19. The exercise machine according to claim 18 further comprising a pair of decks, each said deck positioned generally under the upper surface of a respective said tread belt and supported by a respective said treadle.

20. The exercise machine according to claim 19 further comprising a pair of cushions, each said cushion operably associated with said deck and said treadle.

21. The exercise machine according to claim 18 further comprising tread belt resistance, said tread belt resistance being adjustable to regulate the movement of said tread belt relative to said treadle.

22. The exercise machine according to claim 18 further comprising a motor, said motor operably associated with said tread belt to regulate the speed of said belt relative to said treadle.

23. The exercise machine according to claim 18 further comprising a load resistance, said load resistance operably associated with said crank.

24. The exercise machine according to claim 18 further comprising a flywheel, said flywheel pivotally connected to said framework and operably associated with said crank.

25. The exercise machine according to claim 18 further comprising a flexible linking, said flexible linking operably associated with said crank and said tread belts to coordinate the movement of said tread belts to the rotation of said crank.

26. The exercise machine according to claim 18 further comprising a control system, said control system operably associated with said crank and said tread belts to regulate their relative movements.

* * * * *